US008641268B2

(12) United States Patent
Villar et al.

(10) Patent No.: US 8,641,268 B2
(45) Date of Patent: Feb. 4, 2014

(54) PLATFORM ESCAPEMENT FOR A TIMEPIECE

(75) Inventors: Ivan Villar, Bienne (CH); Marc Lippuner, Bettlach (CH); Sacha Vorpe, Sonvillier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 13/595,112

(22) Filed: Aug. 27, 2012

(65) Prior Publication Data

US 2013/0051190 A1 Feb. 28, 2013

(30) Foreign Application Priority Data

Aug. 29, 2011 (EP) ..... 11179181

(51) Int. Cl.
*G04B 15/00* (2006.01)
*G04B 29/00* (2006.01)

(52) U.S. Cl.
USPC ..... 368/127; 368/132; 368/318

(58) Field of Classification Search
USPC ..... 368/124, 127, 131–133, 169, 318, 324
See application file for complete search history.

(56) References Cited

U.S. PATENT DOCUMENTS

| | | | | | |
|---|---|---|---|---|---|
| 2,524,902 | A | * | 10/1950 | Fengler | 368/178 |
| 3,483,693 | A | * | 12/1969 | Smythe, Jr. | 368/173 |
| 3,896,614 | A | * | 7/1975 | Bachmann | 368/175 |

FOREIGN PATENT DOCUMENTS

| | | | |
|---|---|---|---|
| CH | 700 040 | A1 | 6/2010 |
| DE | 2 041 114 | A1 | 2/1972 |
| EP | 1 804 142 | A1 | 7/2007 |
| EP | 1 804 143 | A1 | 7/2007 |
| EP | 1 978 421 | A2 | 10/2008 |
| FR | 1 545 748 | A | 11/1968 |
| WO | 2010/063129 | A1 | 6/2010 |

* cited by examiner

*Primary Examiner* — Vit W Miska
(74) *Attorney, Agent, or Firm* — Sughrue Mion, PLLC

(57) ABSTRACT

Platform escapement assembly (1) comprising a balance (3) with a roller (4), a balance spring (5), and escape wheel (6) controlled by a pallet lever (7) cooperating with said roller (4).

An escapement bridge (10) comprises, on both sides of a bottom surface (11), first (20) and second (21) spacers respectively comprising first (22) and second (23) bearing surfaces for receiving first (24) and second (25) complementary surfaces of a balance cock (30) on both sides of a top surface (11A), and said top surface (11A) is more flexible in bending than said bottom surface (11), so as to allow mobility, as a result of a perpendicular force applied to said top surface (11A), of said first complementary surface (24) relative to said first bearing surface (22) when said second complementary surface (25) is locked in position on said second bearing (23) surface.

11 Claims, 3 Drawing Sheets

PLATFORM ESCAPEMENT FOR A TIMEPIECE

This application claims priority from European Patent Application No. 11179181.0 filed Aug. 29, 2012, the entire disclosure of which is incorporated herein by reference.

FIELD OF THE INVENTION

The invention concerns a removable platform escapement assembly for a timepiece movement, including at least one balance spring and at least one balance fitted with a roller, and an escape wheel controlled by a pallet lever arranged to cooperate with said roller. Said platform escapement assembly includes an escapement bridge, which comprises, on both sides of a bottom surface fitted with guide bearings, first and second spacers respectively comprising first and second bearing surfaces for receiving first and second complementary surfaces comprised in a balance cock on both sides of a top surface fitted with guide bearings. Said balance cock is positioned relative to said escapement bridge by first and second positioning means, respectively arranged on said first and second bearing surfaces, and said top surface of said balance cock is more flexible in bending than said bottom surface of said escapement bridge, so as to allow mobility, as a result of a force applied at least perpendicularly to said top surface, of said first complementary surface relative to said first bearing surface when said second complementary surface is held locked in position on said second bearing surface, or vice versa.

The invention also concerns a timepiece movement including at least one such platform escapement assembly.

The invention also concerns a timepiece comprising at least one movement of this type.

The invention further concerns a method of adjusting the shake of a removable platform escapement assembly for a timepiece movement, comprising at least one balance spring and at least one balance fitted with a roller, and an escape wheel controlled by a pallet lever arranged to cooperate with said roller.

The invention concerns the field of horology, and more specifically the field of watches including movements fitted with modular sub-assemblies.

BACKGROUND OF THE INVENTION

The production of modular timepiece sub-assemblies requires prefabrication to integrate adjustments which render the sub-assembly ready for use, and to avoid any further adjustments once the sub-assembly has been integrated in an assembly of higher rank.

In the particular case of a sub-assembly carrying a sprung balance assembly and an escape wheel, a known means of assembling a balance on a movement consists in pinning the sprung balance assembly up to a balance cock, and then adding this unit to a movement, pre-assembled with the escape wheel and the pallet lever. Once the balance-balance cock assembly has been mounted on the movement, a recurring difficulty arises as regards controlling the vertical shake of the balance between pivots on bearings or shock absorbers, which will be referred to in the description by the generic term "bearings". To overcome this problem, systems of adjusting the balance shake are sometimes used.

If the overriding objective is to assemble the movement in an entirely automated and inexpensive manner, this method of pinning and assembling the balance on the movement is complex, since the process involves turning over the balance-balance cock assembly. Moreover, when the movement is being assembled, the balance remains suspended via the balance spring, which complicates handling.

The usual means of adjusting the balance shake generally comprises elements that are added, such as screws, nuts, springs, or suchlike, which can create an adjustment mechanically. The increase in the number of components linked to the presence of these adjusting means increases the price of the movement components and increases the number of assembly operations and thereby the total cost.

EP Patent Application No. 1804 142 A1 in the name of ETA SA and OMEGA SA discloses a device for adjusting the shake of a wheel set rotating between two bearings, one in a bridge and the other in a bottom roller. The means of adjustment includes an element for adjusting the distance between a base of the bridge and the bottom roller. The adjusting element has a first hole for a securing screw and can be activated through a second hole machined into the base and passing therethrough. The securing screw is inserted into the second hole to secure the base to the bottom roller, but is not in place in the second hole when the adjusting element is actuated from the top surface of the bridge opposite the bottom roller and through the second hole in order to adjust the shake of the rotating wheel set.

EP Patent Application No. 1804 143 A1 in the name of ETA SA and OMEGA SA discloses a means of adjustment for a similar rotating wheel set, formed, on the one hand, by a conventional means of securing a first portion of the bridge to the bottom roller leaving said first portion in a fixed position relative to the bottom roller and, on the other hand, by a means of deforming the bridge, which is arranged to vary the relative position between a second portion of the bridge and the bottom roller by deforming said bridge. These first and second portions of the bridge are arranged so that activating the bridge deforming means causes a variation in the distance between the first bearing and the second bearing.

SUMMARY OF THE INVENTION

The invention proposes to form a platform escapement module, which is pre-adjusted and can easily be integrated in a movement. The invention sets in place conditions favourable for performing an irreversible adjustment.

Moreover, the platform escapement module according to the invention is developed so that it can be assembled in an automated manner, and in particular in one direction and sense. All of the components must be able to be set in place, secured and adjusted in combination with each other on a single side of an assembly surface.

The invention therefore concerns a removable platform escapement assembly for a timepiece movement, including at least one balance spring and at least one balance fitted with a roller, and an escape wheel controlled by a pallet lever arranged to cooperate with said roller. Said platform escapement assembly includes an escapement bridge, which comprises on both sides of a bottom surface fitted with guide bearings, first and second spacers respectively comprising first and second bearing surfaces for receiving first and second complementary surfaces comprised in a balance cock on both sides of a top surface fitted with guide bearings. Said balance cock is positioned relative to said escapement bridge by first and second positioning means respectively arranged on said first and second bearing surfaces, and said top surface of said balance cock is more flexible in bending than said top surface of said escapement bridge, so as to allow mobility, as a result of a force applied at least perpendicularly to said top surface, of said first complementary surface relative to said first bearing surface when said second complementary surface is held locked in position on said second bearing surface, or vice versa. The invention is characterized in that said bottom surface is fitted with a balance spring stud for securing said at least one balance spring, a bottom balance bearing for guiding a bottom balance pivot of said balance, a bottom pallet lever bearing for guiding a bottom pallet lever pivot of said pallet lever, and a bottom escapement bearing for guiding a bottom escapement pivot of said escape wheel, and in that said top surface is provided with a top balance bearing for guiding a top balance pivot of said balance, a top pallet lever bearing for guiding a top pallet lever pivot of said pallet lever and a top escapement bearing for guiding a top escapement pivot of said escape wheel.

According to a feature of the invention, said balance cock is fixed with said first complementary surface in a particular position relative to said first bearing surface, when said second complementary surface is held locked in position on said second bearing surface, or vice versa, which corresponds to an adjustment of the shake of said balance in the position where said escapement bridge and said balance cock are closest to each and wherein said balance can pivot freely.

According to a feature of the invention, said adjustment of the shake of said balance is obtained after said balance cock has been introduced, in a position of maximum closeness of said balance cock to said escapement bridge, on said top balance pivot of said balance, pre-assembled via the bottom pivot thereof in said balance bearing carried by said bottom surface. In said position of maximum closeness, said balance is clamped, at least on said bottom balance pivot against said bottom balance bearing, and/or on said top balance pivot against said top balance bearing, and after application of a force substantially perpendicular to said top surface which has the tendency to move said escapement bridge and one end of said balance cock away from each other via an elastic deformation of said balance cock, the intensity of said force being just sufficient to allow said balance to pivot freely as result of a tangential force.

The invention further concerns a timepiece movement including at least one platform escapement of this type, characterized in that, when said platform escapement is in an assembled position, said escape wheel cooperates with a gear train comprised in said movement external to said platform escapement.

The invention also concerns a timepiece comprising at least one movement of this type.

The invention further concerns a method of adjusting the shake of a removable platform escapement for a timepiece movement, including at least one balance spring and at least one balance provided with a roller, and an escape wheel controlled by a pallet lever arranged to cooperate with said roller, characterized in that:

said platform escapement is fitted with an escapement bridge comprising, on both sides of a bottom surface fitted with guide bearings, first and second spacers respectively comprising first and second bearing surfaces for receiving first and second complementary surfaces comprised in a balance cock on both sides of a top surface fitted with guide bearings, said balance cock being positioned relative to said escapement bridge by first and second positioning means respectively arranged on said first and second bearing surfaces, and where said top surface of said balance cock is more flexible in bending than said bottom surface of said escapement bridge, so as to allow mobility, as a result of a force applied at least perpendicularly to said top surface, of said first complementary surface relative to said first bearing surface when said second complementary surface is held locked in position on said second bearing surface, or vice versa, said bottom surface is fitted with a balance spring stud for securing said at least one balance spring, a bottom balance bearing for guiding a bottom balance pivot of said balance, a bottom pallet lever bearing for guiding a bottom pallet lever pivot of said pallet lever, and a bottom escapement bearing for guiding a bottom escapement pivot of said escape wheel, said top surface is fitted with a top balance bearing for guiding a top balance pivot of said balance, a top pallet lever bearing for guiding a top pallet lever pivot of said pallet lever, and with a bottom escapement bearing for guiding a top escapement pivot of said escape wheel, said at least one balance spring, said at least one balance, said escape wheel and said pallet lever are mounted in their respective bearings, said balance cock is fixed with said first complementary surface in a particular position relative to said first bearing surface when said second complementary surface is held locked in position on said second bearing surface, or vice versa, which corresponds to an adjustment of the shake of said balance in the position of maximum closeness of said escapement bridge to said balance cock, in which said balance pivots freely, said balance cock is locked in said particular position by welding or adhesive bonding.

According to a feature of the invention, to obtain said adjustment of the shake of said balance:

said balance cock is introduced, in a position of maximum closeness to said escapement bridge, on said top balance pivot of said balance, pre-assembled via said bottom balance pivot in said balance bearing carried by said bottom surface, and in said position of maximum closeness, said balance is clamped both on said bottom balance pivot against said bottom balance bearing and on said top balance pivot against said top balance bearing, said second complementary surface is locked in position on said second bearing surface, a force substantially perpendicular is applied to said top surface tending to move said escapement bridge and one end of said balance cock away from each other by elastically deforming said balance cock, the intensity of said force being just sufficient to allow said balance to pivot freely as a result of a tangential force, until said balance is released.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
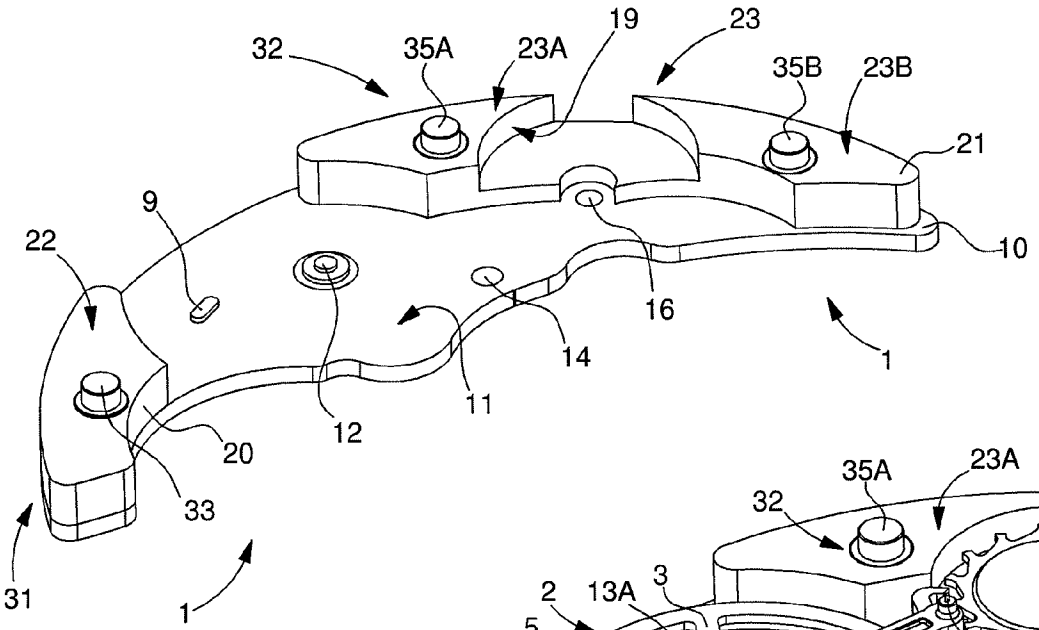
FIG. 1 shows a schematic, perspective view of an escapement bridge comprised in a removable platform escapement according to the invention, fitted with spacers on both sides of a bottom surface, to which are fixed a balance spring stud and guide bearings, the spacers being provided with positioning studs.

The invention concerns the field of horology, and more specifically the field of watches including movements fitted with modular sub-assemblies.

To facilitate the automated assembly of a module carrying an oscillator on the movement, a platform escapement type architecture has been selected, which is also pre-assembled in an automated manner. The invention therefore concerns a platform escapement module, which is pre-adjusted and can easily be integrated in a movement, particularly by centering and pivoting. This platform escapement module is irreversibly adjusted as regards the balance shake at the sub-assembly stage, prior to assembly in a movement.

It is an object of the invention to create the conditions for perfect reproducibility, since any platform escapement module from an automated production line must be perfectly interchangeable with another.

The architecture of this platform escapement module is developed so that it can be assembled in an automated manner, and in particular in one direction and sense. All of the components are set in place, secured, adjusted, and combined with each other, on a single side of an assembly surface.

As seen in the Figures, a removable platform escapement assembly 1 for a timepiece movement 100 includes an oscillator or a sprung balance assembly 2, which in turn comprises at least one balance spring 5 and at least one balance 3, provided with a roller 4.

In other possible variants which are not illustrated in the Figures, platform escapement 1 can comprise a different type of oscillator, in particular one which has no balance spring, for example a magnetic and/or electrostatic oscillator. The oscillator imparts a periodic movement to a wheel set pivoting about a pivot axis, and the application presented here for the preferred case of a sprung balance assembly can be transferred with no limitations to another type of oscillator, since the following reasoning, which relates to adjusting the shake of a balance, can be adapted to adjusting the shake of an oscillator wheel set which is periodically moved and periodically allows an escape wheel or similar element to pivot. This embodiment is therefore in no way limiting.

Platform escapement assembly 1 further comprises an escape wheel 6, controlled here by a pallet lever 7, arranged to cooperate with roller 4.

According to the invention, this platform escapement assembly 1 includes an escapement bridge 10. Escapement bridge 10 includes, on both sides of a bottom surface 11 fitted with guide bearings, first 20 and second 21 spacers respectively comprising first 22 and second 23 bearing surfaces. These bearing surfaces are arranged to receive first 24 and second 25 complementary surfaces comprised in a balance cock 30, on both sides of a top surface 11A of balance cock 30. This top guide surface 11A is fitted with guide bearings, which face those of bottom surface 11.

Balance cock 30 is positioned relative to said escapement bridge 10 by first 31 and second 32 positioning means, which are preferably respectively arranged on the first 22 and second 23 bearing surfaces.

According to a particular feature of the invention, the top surface 11A of balance cock 30 is more flexible in bending than the bottom surface 11 of escapement bridge 10, so as to allow mobility, as a result of a force applied at least perpendicularly to top surface 11A, of the first complementary surface 24 relative to the first bearing surface 22, when the second complementary surface 25 is held locked in position on the second bearing surface 23, or vice versa.

The reverse configuration is mentioned for the record and will not be referred to in the following description, but those skilled in the art will know how to reverse the relative functions of the various surfaces present in order to adjust the balance shake, as explained below.

Naturally, the reverse configuration of an escapement bridge 30 which is more flexible than balance cock 30 can also be envisaged, but it is much less practical for making an assembly entirely formed on a single side of a reference surface, which is formed here by bottom surface 11.

In the variant with sprung balance assembly 2 illustrated in the Figures, bottom surface 11 of escapement bridge 10 is fitted with a balance spring stud 9 for securing at least one balance spring 5, a bottom balance bearing 12, for guiding a bottom balance pivot 13 of balance 3, a bottom pallet lever bearing 14 for guiding a bottom pallet lever pivot 15 of pallet lever 7, and a bottom escapement bearing 16 for guiding a bottom escapement pivot 17 of escape wheel 6.

These bearings are advantageously mounted and secured in place in a first assembly operation, as seen in FIG. 1, which shows escapement bridge 10 pre-equipped after this first operation, in which all the means of presenting components, machining, driving in operations, or adhesive bonding or welding, are all on the same side of bottom surface 11. During the same first operation, spacers 20 and 21 are also mounted, if they do not form a single piece with escapement bridge 10. However, to minimise the number of components, it is advantageous to integrate them in the escapement bridge. Preferably, as illustrated in the Figures, the first 31 and second 32 positioning means, are respectively arranged on the first 22 and second 23 bearing surfaces, which are in the form of studs here, respectively 33 and 35, which can be mounted during the same first assembly operation.

Preferably, if one of the spacers, here the first spacer 20, has a single first bearing surface 22 and a single positioning stud 33, the other spacer, here the second spacer 21, has a second bearing surface 23 divided into two bearing surfaces 23A and 23B, each comprising a positioning stud, respectively 35A and 35B. Thus, it is possible for the precise positioning of balance cock 30, along a perpendicular plane to the pivot axes of the various wheel sets, to be ensured by only one of the spacers, here second spacer 21. In the variant illustrated in the Figures, between the two studs 35A and 35B, the second spacer is hollowed out locally and comprises a chamber 19 allowing escape wheel 6 to pivot freely. It is also possible to devise the second spacer 21 in two parts, but the embodiment illustrated here has the advantage of making escapement bridge 10 very rigid in proximity to escapement bearing 16, which guarantees a constant position of the bearing relative to studs 35A and 35B.

Symmetrically, top surface 11A of balance cock 30 is fitted with a top balance bearing 12A for guiding a top balance pivot 13A of balance 3, a top pallet lever bearing 14A for guiding a top pallet lever pivot 15A of pallet lever 7, and a top escapement bearing 16A for guiding a top escapement pivot 17A of escape wheel 6. The surface comprises housings facing the positioning studs: housing 34 opposite stud 33, and housings 36A and 36B opposite studs 35A and 35B. Although the studs and housing shown here are cylindrical, other shapes capable of ensuring proper positioning may also be envisaged. Naturally, a female/male configuration, or a mixed configuration can be adopted instead of the male/female configuration illustrated in the Figures.

Figure 2:
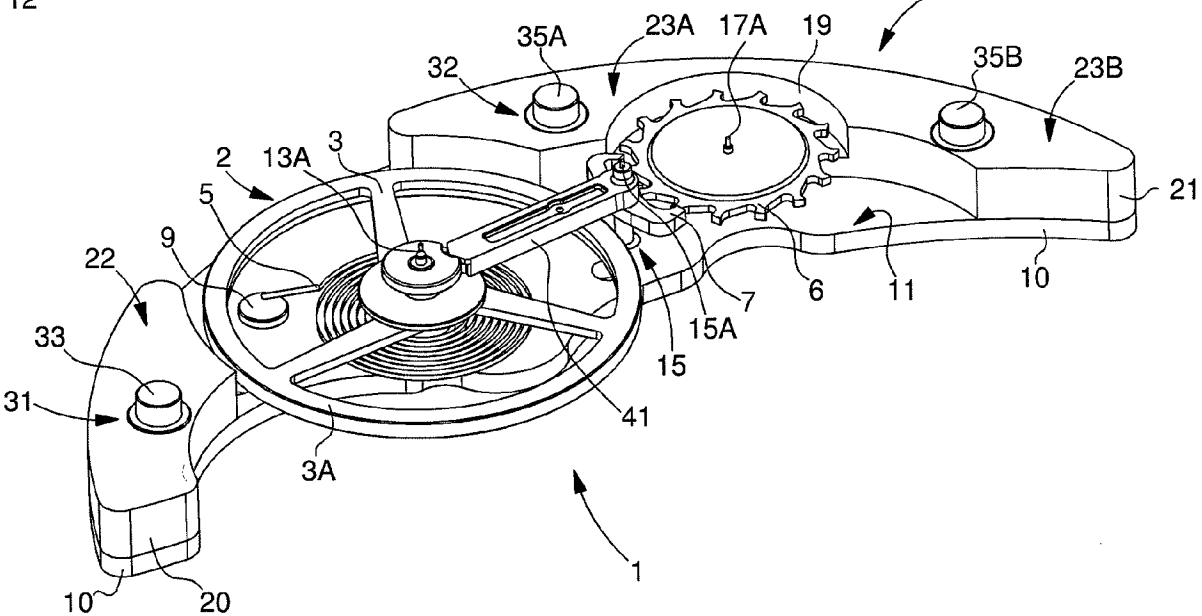
FIG. 2 shows a schematic, perspective view of the escapement bridge of FIG. 1, fitted with a balance spring, a balance, a pallet lever and an escape wheel, each pre-assembled in a cantilever arrangement and held by a single pivot cooperating with a corresponding bearing of the bottom surface.

The bearings of balance cock 30 are advantageously mounted and fixed in place in a pre-assembly operation, where top surface 11A is turned towards the means of assembly, in a similar manner to bottom surface 11 in the first assembly operation shown in FIG. 1, A second assembly operation consists in completing the fitting of pre-equipped escapement bridge 10, by positioning and assembling the at least one balance spring 5, the at least one balance 3, escape wheel 6 and pallet lever 7 in their respective bearings, and pinning balance spring 5 up to stud 9, as seen in FIG. 2.

In a third assembly operation, balance cock 30 is moved opposite escapement bridge 10, so that housings 34 and 36 are matched with studs 33 and 35 of escapement bridge 10, and so that the top bearings guide the top pivots concerned, i.e. respectively top balance bearing 12A with top balance pivot 13A of balance 3, top escapement bearing 16A with top escapement pivot 17A of escapement 6, and top pallet lever bearing 14A with top pallet lever pivot 15A of pallet lever 7.

Figure 3:
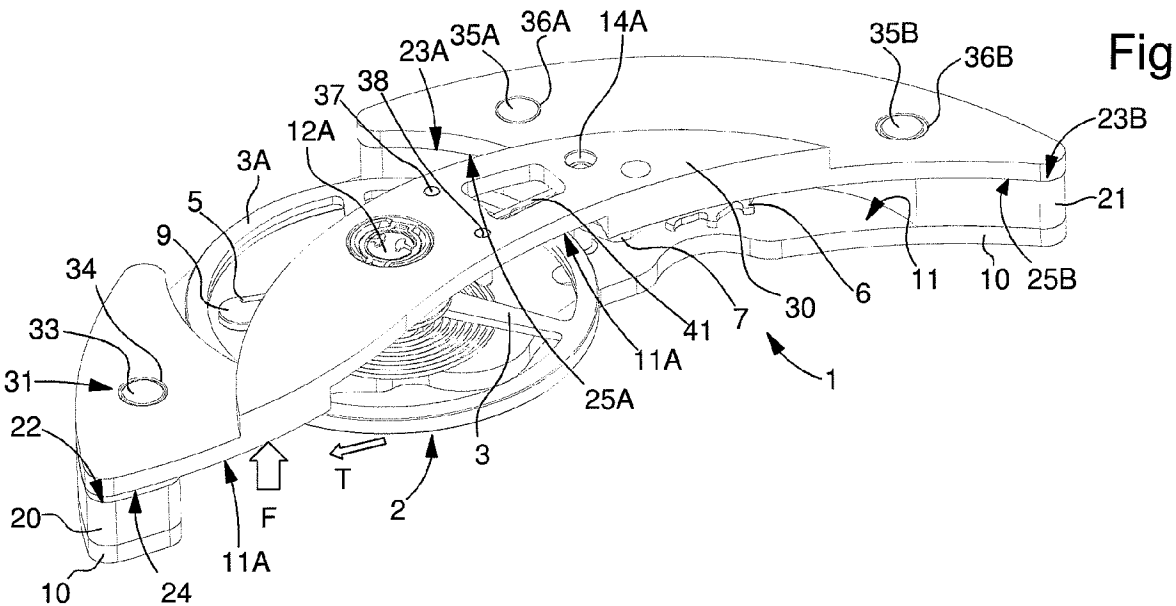
FIG. 3 shows a schematic, perspective view of a removable platform escapement assembly according to the invention, comprising the platform escapement of FIG. 2, which is covered by a balance cock, which has a top surface provided with bearings which cooperate with the second pivots of the balance spring, the balance, the pallet lever and the escape wheel, and said balance cock further comprising bores cooperating with the positioning studs of the escapement bridge.

This third assembly operation is concluded in a position of maximum closeness of escapement bridge 10 to balance cock 30, as seen in FIG. 3.

In this position of maximum closeness, balance 3 is clamped, at least on bottom balance pivot 13 against the bottom balance bearing 12, and/or on top balance pivot 13A against the top balance bearing 12A. Balance 3 is thus clamped in a butting position, and cannot pivot as a result of reasonable torque, i.e. of the same order of magnitude as that applied during use by the oscillator, or by balance spring 5 in this case.

Preferably, in this position of maximum closeness, the second bearing surface 23 of second spacer 21 is in contact with the second complementary surface 25 of balance cock 30.

At this stage, it is advantageous to lock the second complementary surface 25 in position on second bearing surface 23, and in particular, to secure housings 36A and 36B and studs 35A and 35B to each other, particularly by welding and/or adhesive bonding, or suchlike.

A fourth adjustment operation consists in unclamping the balance and adjusting the shake of balance 3 to a minimum value.

Figure 4:
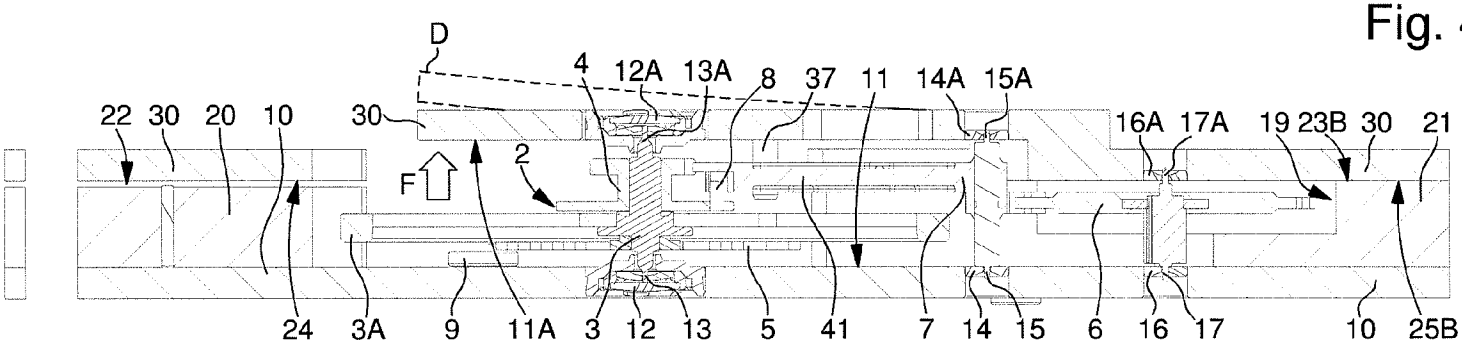
FIG. 4 shows a schematic cross-section passing through the pivot axes of the balance spring, balance, pallet lever and escape wheel, of the removable platform escapement of FIG. 3, shows in a first assembly position and, in a dotted line, in a position where the balance cock is elastically deformed during an adjustment of the shake of the balance prior to the conclusion of assembly of said platform escapement.

To achieve this, a force substantially perpendicular F is applied to top surface 11A, as seen in FIG. 4. This force tends to move escapement bridge 10 and one end of balance cock 30 away from each other by elastically deforming cock 30.

FIG. 4 shows in dotted lines a deformation D obtained as a result of this force F, which is of low amplitude, but sufficient to alter the relative positioning of the pivots and bearings holding balance 3 and to release said balance.

The intensity of force F is just sufficient to allow balance 3 to pivot freely as a result of a tangential force T applied to a felloe 3A comprised in balance 3, as shown in FIG. 3, until balance 3 is released. This tangential force T results in balance 3 being subject to the application of a torque lower than the reference torque which is applied thereto during use by the oscillator, or by balance spring 5 in the present case. Preferably, the torque resulting from the tangential force T applied during this adjusting operation is much lower than the reference torque, particularly less than a tenth of the value thereof. In practice, it is advantageously applied in the form of a flow of air to felloe 3A.

Balance cock 30 is then fixed, as soon as balance 3 is released, with first complementary surface 24 in the particular position relative to first bearing surface 22, whereas second complementary surface 25 is held locked in position on second bearing surface 23.

This particular position therefore corresponds to an adjustment of the shake of balance 3 in the position of maximum closeness of escapement bridge 10 to balance cock 30, in which balance 3 can pivot freely.

In short, after the introduction of balance cock 30, in a position of maximum closeness of balance cock 30 to escapement bridge 10, on the top balance pivot 13A of balance 3, which is pre-assembled via the bottom pivot 13 thereof in balance bearing 12 carried by bottom surface 11, such that balance 3 is clamped, in said position of maximum closeness, at least on the bottom balance pivot 13 against the bottom balance bearing 12 and/or on the top balance pivot 13A against the top balance bearing 12A, the adjustment of the shake of balance 3 is obtained after the application to the top surface 11A of a force substantially perpendicular F, which tends to move escapement bridge 10 and one end of balance cock 30 away from each other by elastically deforming said cock, the intensity of said force F being just sufficient to allow balance 3 to pivot freely as a result of a tangential force T applied to felloe 3A of balance 3.

In summary, in the architecture proposed by the invention, all the components of the platform escapement assembly 1 are mounted on the same side, in this sequence:

- bottom ébauche pre-fitted with the pre-equipped escapement bridge 10;
- sprung balance assembly 2 is integrated and pinned up to the stud 9;
- escape wheel 6 and pallet lever 7 are integrated;
- balance cock 30 is integrated.

In this embodiment, the adjustment of the shake of balance 3 is carried out directly on platform escapement assembly 1 prior to being assembled in the movement in the following sequence:

- balance cock 30 is moved onto studs 35A and 35B and secured thereto. In this position, at least one of the pivots of balance 3 is deliberately clamped;
- balance cock 30 is then moved locally by elastic deformation, in order to move balance cock 30 relative to stud 32, until balance 3 is released. To facilitate detection of the release of balance 3, a slight torque is applied thereto, by a tangential force on felloe 3A, thus once released the balance starts to rotate;
- once the release of the balance is detected, balance cock 30 is locked in this position by being secured to stud 32;

In this preferred embodiment, balance spring 5 is arranged between the bottom surface 11 and felloe 3A of balance 3, and pallet lever 7 is arranged on the opposite side, between felloe 3A and said top surface 11A. This peculiarity of balance spring 5 placed underneath felloe 3A is permitted if a balance with no index-assembly is used.

Preferably, pallet lever 7 is pivotally mounted, by the cooperation of a bottom pallet lever bearing 14 for guiding a bottom pallet lever pivot 15 on the one hand, and a top pallet lever bearing 14A for guiding a top pallet lever pivot 15A on the other hand, the pivot axis defined between these pivots being external to the felloe 3A of balance 3. Since the pivoting of the pallet lever is pushed outside the felloe there is no need to use a pallet-cock.

Figure 5:
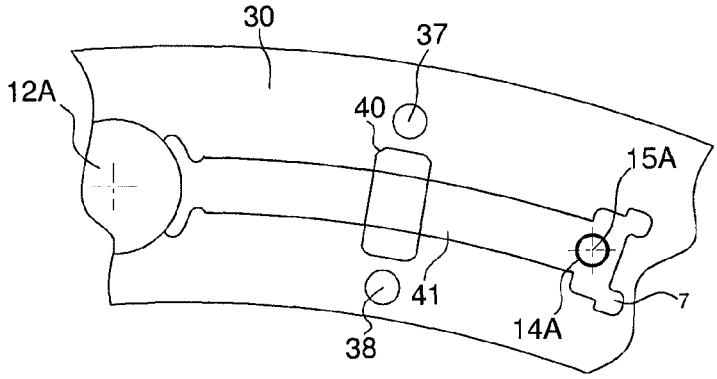
FIG. 5 shows a schematic, transparent plane view of a first variant comprising two limit stops for the pallet lever, fixed to the balance cock.

FIG. 5 illustrates a first variant in which the pivoting of pallet lever 7 is limited by banking pins 37, 38, projecting from the top surface 11A of a balance cock 30, which limit the clearance of an arm 41 of said pallet lever 7.

Figure 6:
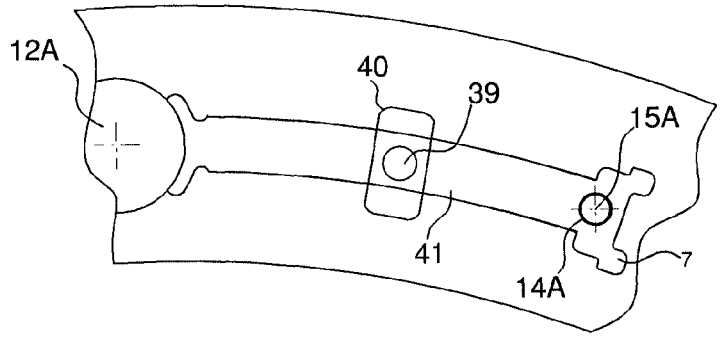
FIG. 6 shows a schematic, transparent plane view of a second variant comprising a banking pin which is fixed to the arm of the pallet lever, cooperating with hole arranged in the balance cock which limits the travel of said pin.
Figure 7:
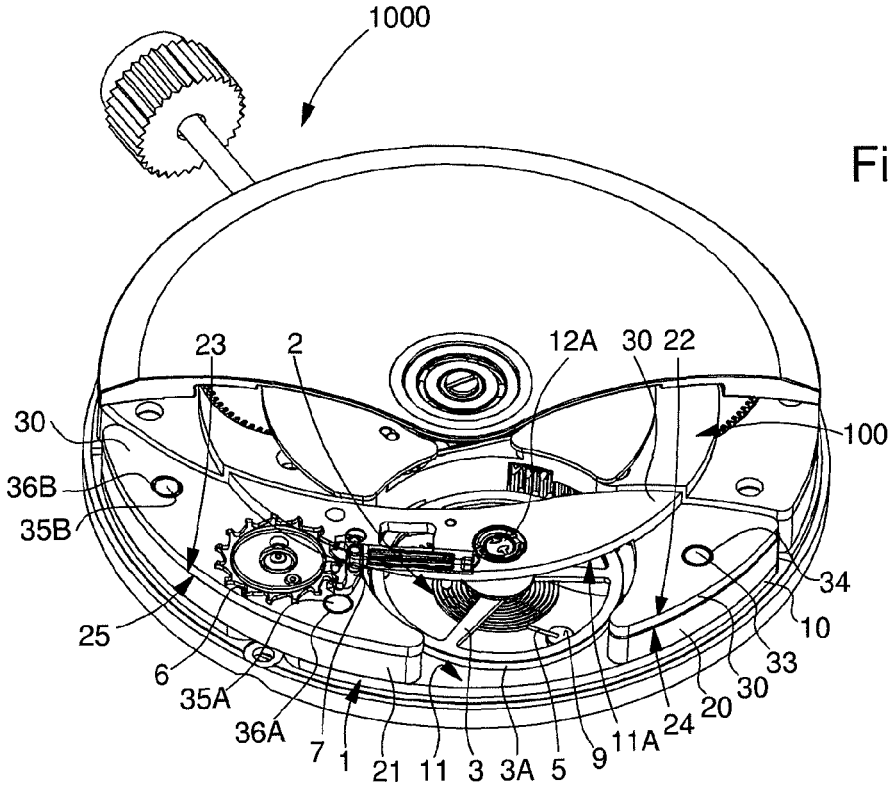
FIG. 7 shows a schematic, perspective view of a watch including a movement incorporating a removable platform escapement according to the invention.

FIG. 6 illustrates a second variant in which an arm 41 of pallet lever 7 carries a banking pin 39 which can move in a hole 40 comprised in balance cock 30, to limit the pivoting of pallet lever 7.

The invention also concerns a timepiece movement 100 including at least one such platform escapement assembly 1. According to the invention, when said platform escapement assembly 1 is in an assembled position, escape wheel 6 cooperates with a gear train comprised in movement 100 external to said platform escapement assembly 1.

The invention also concerns a timepiece 1000 including at least one such movement 100.

In short, compared to a prior art assembly comprising a standard movement, with a balance spring above the felloe, a pallet lever underneath the felloe, and an index-assembly, the present invention proposes a movement with a new architecture, with a balance spring underneath the felloe, a pallet lever above the felloe and no index-assembly. The new architecture means that the platform escapement assembly can be mounted on the same side in an automated manner. Finally, the system of adjusting the balance shake is carried out without using any additional parts.

What is claimed is:

1. A removable platform escapement assembly for a timepiece movement, including an oscillator or a sprung balance assembly, in turn comprising at least one balance spring and at least one balance fitted with a roller, and an escape wheel controlled by a pallet lever, arranged to cooperate with said roller, wherein said platform escapement assembly includes an escapement bridge, which comprises, on both sides of a bottom surface fitted with guide bearings, first and second spacers respectively comprising first and second bearing surfaces for receiving first and second complementary surfaces comprised in a balance cock on both sides of a top surface fitted with guide bearings, and wherein said balance cock is positioned relative to said escapement bridge by first and second positioning means, respectively arranged on said first and second bearing surfaces, and said top surface of said balance cock is more flexible in bending than said bottom surface of said escapement bridge, so as to allow mobility, as a result of a force applied at least perpendicularly to said top surface, of said first complementary surface relative to said first bearing surface when said second complementary surface is held locked in position on said second bearing surface, or vice versa; wherein said bottom surface is fitted with a balance spring stud for securing said at least one balance spring, a bottom balance bearing for guiding a bottom balance pivot of said balance, a bottom pallet lever bearing for guiding a bottom pallet lever pivot of said pallet lever, and a bottom escapement bearing for guiding a bottom escapement pivot of said escape wheel, and wherein said top surface is provided with a top balance bearing for guiding a top balance pivot of said balance, a top pallet lever bearing for guiding a top pallet lever pivot of said pallet lever and a top escapement bearing for guiding a top escapement pivot of said escape wheel.

2. The platform escapement assembly according to claim 1, wherein said balance cock is fixed with said first complementary surface in a particular position relative to said first bearing surface, when said second complementary surface is held locked in position on said second bearing surface, or vice versa, which corresponds to an adjustment of the shake of said balance in the position of maximum closeness of said escapement bridge to said balance cock, in which said balance pivots freely.

3. The platform escapement assembly according to claim 2, wherein said adjustment of the shake of said balance is obtained after the introduction of said balance cock, in a position of maximum closeness of said balance cock to said escapement bridge, on said top balance pivot of said balance, pre-assembled via the bottom pivot thereof in said balance bearing carried by said bottom surface, wherein, in said position of maximum closeness, said balance is clamped, at least on said bottom balance pivot against said bottom balance bearing, and/or on said top balance pivot against said top balance bearing, and after the application of a force substantially perpendicular to said top surface which has the tendency to move said escapement bridge and one end of said balance cock away from each other via an elastic deformation of said balance cock, the intensity of said force being just sufficient to allow said balance to pivot freely as result of a tangential force applied to a felloe comprised in said balance.

4. The platform escapement assembly according to claim 1, wherein said balance spring is arranged between said bottom surface and the felloe of said balance, and wherein and said pallet lever is arranged on the opposite side, between said felloe and said top surface.

5. The platform escapement assembly according to claim 1, wherein said pallet lever is pivotally mounted, by the cooperation of a bottom pallet lever bearing for guiding a bottom pallet lever pivot on the one hand, and a top pallet lever bearing for guiding a top pallet lever pivot on the other hand, the pivot axis defined between said pivots being external to the felloe of said balance.

6. The platform escapement assembly according to claim 1, wherein the pivoting of said pallet lever is limited by banking pins projecting from said top surface of said balance cock, which limit the clearance of an arm of said pallet lever.

7. The platform escapement assembly according to claim 1, wherein an arm of said pallet lever carries a banking pin which can move in a hole comprised in said balance cock, to limit the pivoting of said pallet lever.

8. The timepiece movement including at least one platform escapement assembly according to claim 1, wherein, when said platform escapement assembly is in an assembled position, said escape wheel cooperates with a gear train comprised in said movement external to said platform escapement assembly.

9. The timepiece including at least one movement according to claim 8.

10. A method of adjusting the balance shake of a removable platform escapement assembly for a timepiece movement, including at least one balance spring and at least one balance provided with a roller, and an escape wheel controlled by a pallet lever arranged to cooperate with said roller, wherein:

said platform escapement is fitted with an escapement bridge comprising, on both sides of a bottom surface fitted with guide bearings, first and second spacers respectively comprising first and second bearing surfaces for receiving first and second complementary surfaces comprised in a balance cock on both sides of a top surface fitted with guide bearings, said balance cock being positioned relative to said escapement bridge by first and second positioning means respectively arranged on said first and second bearing surfaces, and where said top surface of said balance cock is more flexible in bending than said bottom surface of said escapement bridge, so as to allow mobility, as a result of a force applied at least perpendicularly to said top surface, of said first complementary surface relative to said first bearing surface when said second complementary surface is held locked in position on said second bearing surface, or vice versa, said bottom surface is fitted with a balance spring stud for securing said at least one balance spring, a bottom balance bearing for guiding a bottom balance pivot of said balance, a bottom pallet lever bearing for guiding a bottom pallet lever pivot of said pallet lever, and a bottom escapement bearing for guiding a bottom escapement pivot of said escape wheel, said at least one balance spring, said at least one balance, said escape wheel and said pallet lever are mounted in their respective bearings, said top surface is fitted with a top balance bearing for guiding a top balance pivot of said balance, a top pallet lever bearing for guiding a top pallet lever pivot of said pallet lever, and with a bottom escapement bearing for guiding a top escapement pivot of said escape wheel, said balance cock is fixed with said first complementary surface in a particular position relative to said first bearing surface when said second complementary surface is held locked in position on said second bearing surface, or vice versa, which corresponds to an adjustment of the shake of said balance in the position of maximum closeness of said escapement bridge to said balance cock, in which said balance pivots freely, said balance cock is locked in said particular position by welding or adhesive bonding.

11. The method of adjusting the balance shake of a platform escapement assembly according to claim 10, wherein, in order to obtain the shake adjustment of said balance:

said balance cock is introduced, in a position of maximum closeness to said escapement bridge, on said top balance pivot of said balance, pre-assembled via said bottom balance pivot in said balance bearing carried by said bottom surface, and in said position of maximum closeness, said balance is clamped both on said bottom balance pivot against said bottom balance bearing and on said top balance pivot against said top balance bearing, said second complementary surface is locked in position on said second bearing surface, a force substantially perpendicular is applied to said top surface tending to move said escapement bridge and one end of said balance cock away from each other by elastically deforming said balance cock, the intensity of said force being just sufficient to allow said balance to pivot freely as a result of a tangential force applied to a felloe comprised in said balance, until said balance is released.

* * * * *